US005167227A

United States Patent [19]

Meserlian

[11] Patent Number: 5,167,227

[45] Date of Patent: Dec. 1, 1992

[54] APPARATUS FOR MASSAGING AND/OR CONTROLLABLY SUPPORTING THE LEGS OF A HORSE

[76] Inventor: Sarkis B. Meserlian, 341 Old Marlborough Turnpike, Portland, Conn. 06480

[21] Appl. No.: 746,237

[22] Filed: Aug. 15, 1991

[51] Int. Cl.[5] ..... A61H 7/00

[52] U.S. Cl. ..... 128/64; 128/24 R

[58] Field of Search ..... 128/24 R, 402, 64, 87 R, 128/201.24, 89 R, 25 B, 400

[56] References Cited

U.S. PATENT DOCUMENTS

| | | | |
|---|---|---|---|
| 2,365,807 | 4/1943 | Dialynas . | |
| 3,159,160 | 10/1962 | Ullom . | |
| 3,345,987 | 10/1967 | Ediin . | |
| 3,378,004 | 4/1968 | Claycomb | 128/25 B |
| 3,628,537 | 12/1971 | Berndt et al. | 128/402 |
| 3,683,902 | 8/1972 | Artemenko et al. | 128/89 |
| 3,738,367 | 6/1973 | Hardy . | |
| 3,871,381 | 3/1975 | Roslanski | 128/24 R |
| 3,905,367 | 9/1975 | Dapcich | 128/259 |
| 3,993,053 | 11/1976 | Grossan | 128/64 |
| 4,118,946 | 10/1978 | Tubin | 128/379 |
| 4,149,541 | 4/1979 | Gammons et al. | 128/400 |
| 4,184,537 | 1/1980 | Sauder | 128/402 |
| 4,206,751 | 6/1980 | Schneider | 128/24 R |
| 4,217,705 | 8/1980 | Donzis | 128/594 |
| 4,353,359 | 10/1982 | Milbauer | 128/66 |
| 4,478,214 | 10/1984 | Lamont | 128/149 |
| 4,624,248 | 11/1986 | Poole | 128/64 |
| 4,736,800 | 4/1988 | Rohner | 168/18 |
| 4,738,119 | 4/1988 | Zafred | 128/400 |
| 4,747,408 | 5/1988 | Chuan-Chih | 128/400 |
| 4,794,991 | 2/1989 | Honderich | 128/26 |
| 4,926,510 | 5/1990 | Watkins | 128/64 |
| 4,971,044 | 11/1990 | Dye | 128/89 R |
| 4,981,010 | 1/1991 | Orza et al. | 54/82 |

*Primary Examiner*—Robert A. Hafer
*Assistant Examiner*—David J. Kenealy
*Attorney, Agent, or Firm*—Klauber & Jackson

[57] ABSTRACT

Apparatus for massaging the legs of a horse, while also providing controllable air cushion support, includes a boot for encasing at least one foot of a horse, the boot including a flexible tube extending therethrough for permitting circulation of a fluid through the boot, the flexible tube including an inlet and an outlet; a supply of water; an inlet conduit which supplies the water from the supply to the inlet of the flexible tube; an outlet conduit which conveys the water from the outlet of the flexible tube back to the supply; a water pump which pumps the water from the supply to the inlet conduit to control the temperature of each foot of the horse; an air pump which simultaneously pumps air from an air conduit to the inlet conduit in mixing relation with the water to such an extent that the air provides a massaging action to each foot of the horse; an air bladder which provides regulated support for the sole of the hoof of each foot in order to aid in healing of the foot during laminitis, the air bladder being positioned within the boot and beneath the sole of the hoof of each foot; and a pressure bulb which inflates the air bladder to a desired pressure.

15 Claims, 5 Drawing Sheets

APPARATUS FOR MASSAGING AND/OR CONTROLLABLY SUPPORTING THE LEGS OF A HORSE

BACKGROUND OF THE INVENTION

The present invention relates generally to a hydrotherapy apparatus and, more particularly, is directed to apparatus for massaging the legs of a horse, while also providing regulated support for the sole of the hoof of a horse during acute stages of laminitis.

Due to injury or fatigue, the legs of a horse often become inflamed. One method of reducing the inflammation is by medication. However, medication also affects other parts of the horse which, for example, can make the horse sluggish or have various other side effects.

Excluding the medication, various other methods have been used to reduce inflammation to the legs of a horse. For example, one such method which is termed "cold hosing" permits water to run directly from a hose at low pressure onto the affected area for a period of time, for example, twenty minutes. However, this method provides various problems in use. First, it is generally only permissible to treat one leg at a time. Secondly, water temperature in warmer climates, such as Florida, is too warm to have any cooling effect. Third, allowing a foot to be exposed to so much water for extended periods of time can cause the foot to become first, very soft and, when dried, very brittle. Fourth, this method consumes valuable time of the person directing the flow of water.

Another method of reducing inflammation is to provide a leg wrap having a reusable gel-like material therein, for example, of the type sold by 3M Consumer Specialties Division of St. Paul, Minn. under the trademark COLD COMFORT. In such case, the leg wrap is kept in a freezer until it is needed. Once removed from the freezer, the temperature remains below freezing for a time sufficiently long to freeze or cool the flesh of the horse. This, however, is disadvantageous for various reasons. Specifically, the duration of cooling is not consistent, the leg wrap must be replaced often and access to a freezer must be available.

It is also known to use an icing boot which has the appearance of a large fireman's boot or a fisherman's wading boot. With the horse's leg in the boot, the boot is then filled with approximately 10–15 gallons of ice and water. This process has been the preferred method for cooling, since the leg is cooled with ice water. However, even this method provides disadvantages. First, there is the problem of getting the injured horse leg into the boot that extends well over the knee. Installation requires at least two or three people. Further, there is the problem of over saturation of the foot, and third, the horse must remain immobilized for at least twenty minutes, which is difficult.

In many instances, in order to aid in the healing process, a massage may also be given to a horse's leg.

In addition, various U.S. patents show constructions for supplying cooling/heating water to the limbs of a horse or person. For example, U.S. Pat. No. 3,871,381 to Roslonski shows a variety of constructions developed for the purpose of providing a cold compress without fluid leakage, to the limb of a horse or an individual. This patent most notably defines a construction which serves as a cooling wrap in FIG. 4 thereof and as a boot in FIG. 3 thereof. The device may be inflatable.

Compressed refrigerant gas from a tank is used as the refrigerant source.

U.S. Pat. No. 4,149,541 to Gammons et al. is cumulative to some extent with Roslonski. This patent also discloses a pad having a tortuous fluid path exposed therein, for the complete circulation of a cooling fluid therethrough. Although there is no inflatability in the pad of Gammons et al., a circulating fluid is used. Further, the Background of the Invention portion of this patent discloses that the combination of an external device for the cooling and circulation of a fluid such as cold water, using an ice bath or the like, is known.

U.S. Pat. No. 4,184,537 to Sauder relates to an elaborate temperature controlling apparatus that is useful for both heating and cooling, and which is applicable for the treatment of injuries of both humans and animals, as described therein. The patent makes reference to simpler means for circulating refrigerated or cooled liquid, and contemplates that sleeves may be used that may be wrapped around limbs and the like. The device is somewhat more complex than the aforementioned patents by the provision of one-way or check valves, along with other similar mechanisms that control the flow of the refrigerant or heated liquid.

U.S. Pat. No. 3,738,367 to Hardy relates to a full garment for a hospital patient which offers temperature controlled by the provision of tubing for fluid circulation attached to the garment. The garment may, in turn, be attached to a hyperthermia machine, which corresponds to an external fluid cooling apparatus.

U.S. Pat. No. 3,905,367 to Dapcich relates to a sleeve to be wrapped around the limb of a horse to deliver moisture in the form of water directly to the skin surface and, in this regard, is similar to the cold hosing method discussed previously.

U.S. Pat. No. 4,118,946 to Tubin discloses a cooling device that may be detachably worn by humans or animals, and which operates by means of the circulation of a gas under pressure, in conjunction with a sealed heat exchange fluid disposed in a tortuous pathway within the device.

U.S. Pat. No. 4,353,359 to Milbauer also relates to a full body suit composed of detachable portions, for the delivery of liquid directly to the surface of the portion of the body being treated.

U.S. Pat. No. 3,683,902 to Artimenko et al. refers to a specific splint apparatus which provides circulating fluid through a device which is capable of receiving pressure, and thereby providing support to a crushed limb or the like.

Although cooling/heating mechanisms and wraps of the aforementioned type are known in the art, it is often desired to also provide a massaging action to the animals legs in order to increase circulation, that is, to provide a whirlpool-like/hydrotherapy effect that causes stimulation of blood flow.

In this regard, U.S. Pat. No. 4,738,119 to Zafred discloses an integral cooling garment for protection against heat stress. The device is preferably a vest-like garment in which porous tubes are detachably connected to a source of liquid carbon dioxide.

U.S. Pat. No. 3,628,537 to Berndt et al. relates to a cold wrap operating in a similar fashion to that of Zafred in the provision of a volatile refrigerant that, in its final stages, becomes gaseous. The device as shown in the Figures appears to have a substance akin to dry ice which is initially disposed in solidify form and, as it vaporizes, achieves some form of stimulatory effect. A specific check valve is provided to permit the escape of the gaseous carbon dioxide during use.

U.S. Pat. No. 4,747,408 to Chuan-Chih discloses a portable sauna-bath jacket having a supply of both cooling water and hot air which facilitates alternative circulation of the cooling water or the warm air, for the purpose of controlling the temperature of the wearer. Specifically, the warm air is provided to impart a sauna-type effect, followed by a cooling water supply which is intended to impart a similar effect to jumping in a cold shower after a sauna.

U.S. Pat. No. 3,159,160 to Ullom relates to a device for use in relieving pain and discomfort from headache by the application of the combination of pressure and heat or cold to an affected body area. Either a liquid and/or air can be used for the purpose of achieving the pressure application designed to counteract headaches. There is, however, no continuous flow of fluid therethrough to provide a massaging effect.

U.S. Pat. No. 3,345,987 to Ediin relates to a pressurized face mask apparently for the application of heat to a beard prior to shaving. Hot air is circulated through the mask and thereby heats and softens the beard before shaving is attempted.

It will be appreciated that none of the above patents provides a hydrotherapy effect with the simultaneous flow of water and air therethrough.

Related to the problem of inflammation of a horse's legs is the problem of laminitis. Specifically, the part of the foot which holds the bone to the hoof wall is called the laminae. During laminitis, this area becomes inflamed and congested with blood, causing severe pain.

If the problem is not addressed, the coffin bone will detach itself from the hoof wall and rotate downwardly. Some studies have shown that, by either providing support and heating or cooling, the condition can be relieved.

In this regard, U.S. Pat. No. 4,794,991 to Honderich discloses a device for the treatment of laminitis which consists of a baseplate of fixed construction which defines an upward curvature as shown in FIGS. 4 and 6 thereof, over which is disposed a rubber interstitial layer and a cushion layer. The device is designed to be positioned between a horseshoe and the horse's foot to facilitate the treatment comprising the rotation of the coffin bone into the proper alignment. The pad in Honderich, however, is not inflatable and also relies upon a fastening of the device to the horse's hoof via the installation of a conventional horseshoe, thereby rendering the device impractical.

U.S. Pat. No. 2,365,807 to Dialynas discloses an inflatable arch for use with a conventional shoe for a person.

U.S. Pat. No. 4,478,214 to Lamont discloses a boot construction for the injured feet of a person. This device discloses a fluid cushion member in FIG. 4 for supporting the rear and lateral surfaces of the ankle adjacent the heel. There is no disclosure in this patent of the condition of laminitis that is specific to horses.

U.S. Pat. No. 4,217,705 to Donzis is cumulative with those above and relates to human footwear having provided therein an inflatable sole member.

U.S. Pat. No. 4,981,010 to Orza et al. relates to a specially molded horseshoe that provides support not only across the bottom, but along the lower sides of the horse's foot. This device, however, is limited to the specially molded configuration and is not intended to prevent laminitis.

U.S. Pat. No. 4,736,800 to Rohner discloses a removable horse's shoe providing a shroud having, at the top thereof, a means for fastening by a band about the fetlock region of the horse's leg.

OBJECTS AND SUMMARY OF THE INVENTION

Accordingly, it is an object of the present invention to provide apparatus for cooling/heating and massaging the legs of a horse that avoids the aforementioned problems with the prior art.

More particularly, it is an object of the present invention to provide apparatus for cooling/heating and massaging the legs of a horse, regardless of the ambient temperature.

It is still another object of the present invention to provide apparatus for cooling/heating and massaging the legs of a horse which does not directly expose the legs and feet of the horse to a liquid.

It is yet another object of the present invention to provide apparatus for cooling/heating and massaging the legs of a horse which can be used while unattended.

It is a further object of the present invention to provide apparatus for cooling/heating and massaging the legs of a horse that can be formed as a wrap and/or a boot.

It is a still further object of the present invention to provide apparatus for cooling/heating and massaging the legs of a horse, with an inflatable pad for providing regulated support for the sole of the hoof during acute stages of laminitis.

In accordance with an aspect of the present invention, apparatus for massaging the legs of a horse, includes flexible wrapping means for encasing a portion of at least one leg of a horse, the flexible wrapping means including passage means for permitting circulation of a fluid through the flexible wrapping means, the passage means including an inlet and an outlet; inlet conduit means for supplying liquid from a supply to the inlet of the passage means; outlet conduit means for conveying the liquid from the outlet of the passage means back to the supply; and pump means for pumping the liquid from the supply to the inlet conduit means to control the temperature of the at least one leg of the horse and for simultaneously pumping air to the inlet conduit means in mixing relation with the liquid to such an extent that the air provides a massaging action to the at least one leg of the horse.

In accordance with another aspect of the present invention, apparatus for massaging and controllably supporting the legs of a horse, includes boot means for encasing at least one foot of a horse, the boot means including passage means for permitting circulation of a fluid through the boot means, the passage means including an inlet and an outlet; inlet conduit means for supplying liquid from a supply to the inlet of the passage means; outlet conduit means for conveying the liquid from the outlet of the passage means back to the supply; pump means for pumping the liquid from the supply to the inlet conduit means to control the temperature of the at least one foot of the horse and for simultaneously pumping air to the inlet conduit means in mixing relation with the liquid to such an extent that the air provides a massaging action to the at least one foot of the horse; air bladder means for providing regulated support for the sole of the hoof of each foot in order to aid in healing of the foot during laminitis, the air bladder means being positioned within the boot means and beneath the sole of the hoof of each foot; and inflation means for inflating the air bladder means to a desired pressure.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
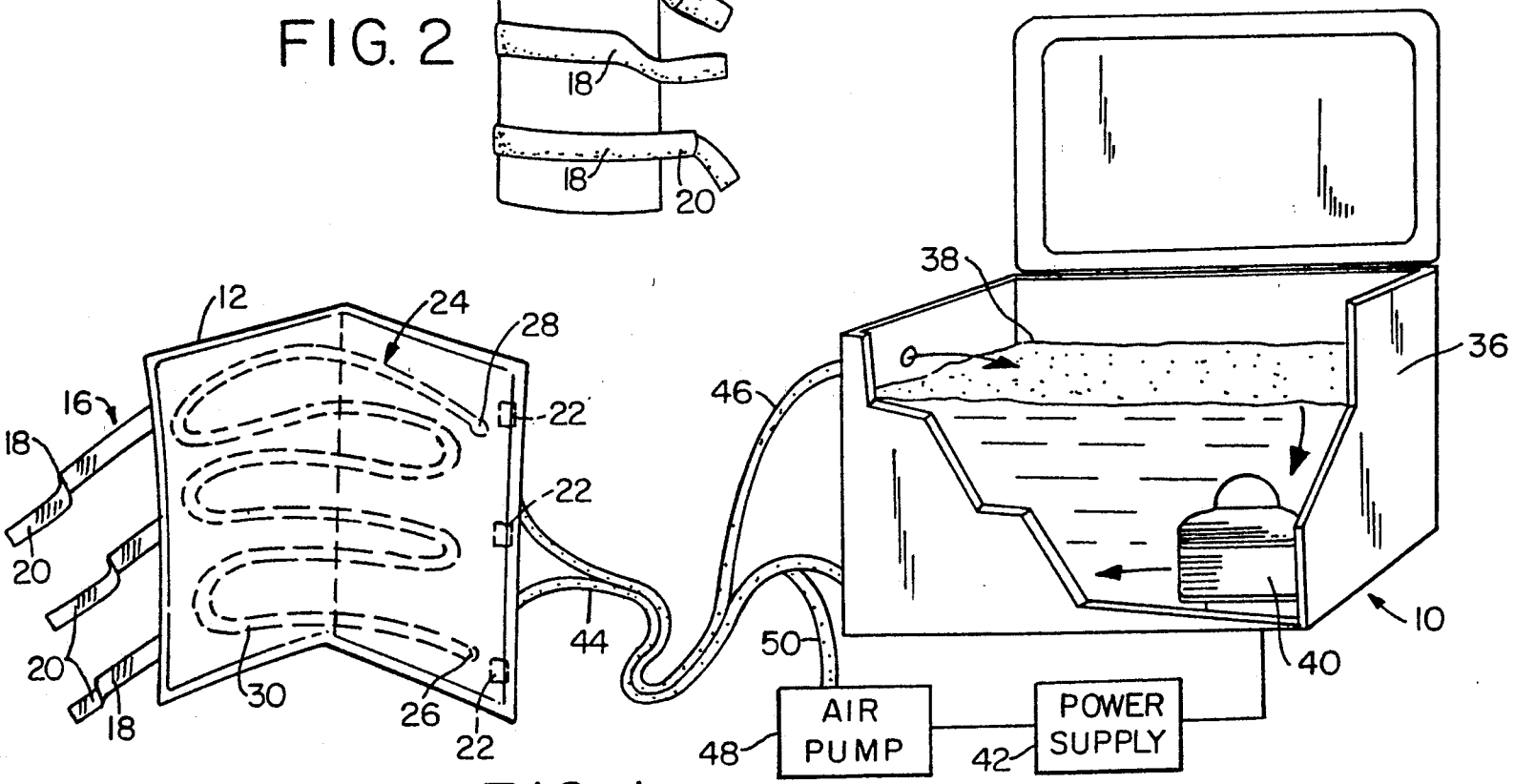
FIG. 1 is a perspective view of apparatus for massaging the legs of a horse according to one embodiment of the present invention.
Figure 2:
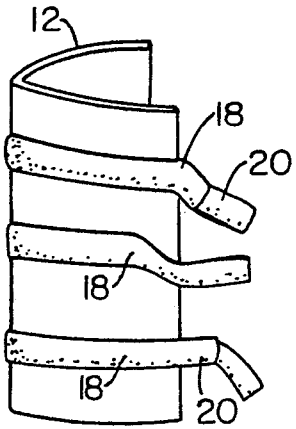
FIG. 2 is a perspective view of the wrap of the apparatus of FIG. 1.

Referring to the drawings in detail, and initially to FIGS. 1–6 thereof, apparatus 10 for massaging the legs of a horse includes a flexible wrapping 12 for encasing a portion of at least one leg 14 of a horse. The flexible wrapping includes securement means 16 for releasably securing the wrapping about the respective leg of a horse. For example, securement means 16 can include a plurality of straps 18, each having "VELCRO"-like hooks 20 at the free end thereof which secure onto "VELCRO"-like loops 22 mounted to the opposite side of flexible wrapping 12.

Figure 3:
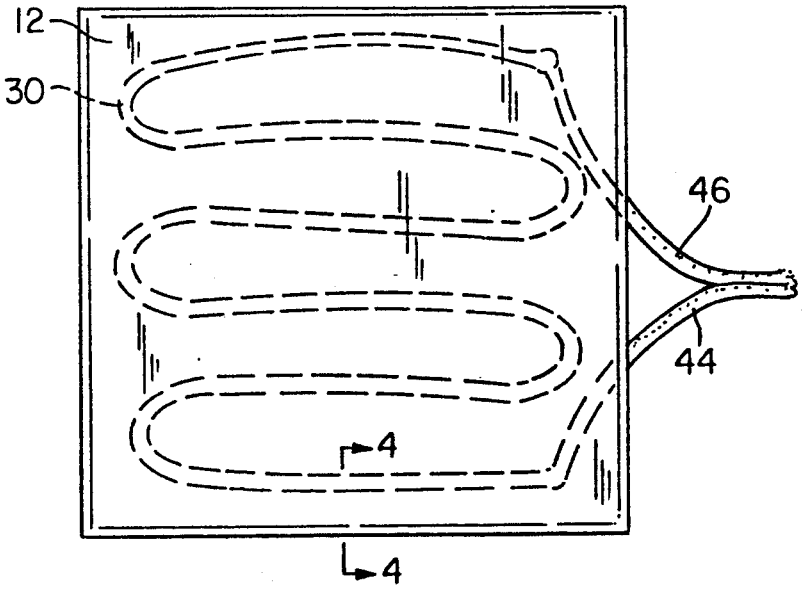
FIG. 3 is a plan view of the wrap of the apparatus of FIG. 2.
Figure 4:
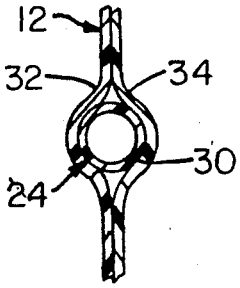
FIG. 4 is a cross-sectional view of a portion of the wrap of FIG. 3, taken along line 4—4 thereof.
Figure 5:
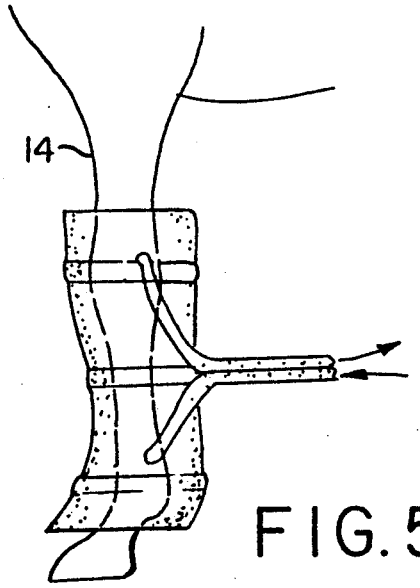
FIG. 5 is an elevational view showing the wrap encasing a horse's leg.

Flexible wrapping 12 includes passage means 24 for permitting circulation of a fluid through flexible wrapping 12, passage means 24 including an inlet opening 26 and an outlet opening 28. For example, as shown in FIGS. 1, 3 and 4, passage means 24 can be comprised of a flexible tubing 30 which is sandwiched between opposite flexible panels 32 and 34 which form flexible wrapping 12. Preferably, flexible wrapping 12 is made of bonded vinyl panels 32 and 34, and is sheathed with a "GORETEX"-type outer insulating layer (not shown).

Tubing 30 starts at inlet opening 26 and terminates at outlet opening 28. As shown in FIGS. 1 and 3, flexible tubing 30 is positioned so as to extend between inlet opening 26 and outlet opening 28 in a tortuous, sinusoidal type manner. In this way, a large part of the surface of flexible wrapping 12 can be affected by the liquid passing through flexible tubing 30.

Apparatus 10 further includes a supply 36 of a liquid 38, which is preferably water. For example, a cooling liquid 38 can be formed by water having ice therein. Preferably, however, a heating element such as a heating coil (not shown) or the like can be provided, along with a thermostat, to ensure a constant warm temperature of the liquid. A pump 40 is mounted within supply 36 and is powered by a power supply 42, which can be from an electrical outlet or a battery. For total mobility and portability, pump 40 can be a 12 volt pump which has the option of being run on a rechargeable nicad battery, a cigarette lighter adapter from a car or truck, or from converted 110 V to 120 V electric current.

An inlet conduit 44 connects supply 36 with inlet opening 26 and an outlet conduit 46 connects outlet opening 28 with supply 36. In this manner, pump 40 can pump the liquid 38 from supply 36 to inlet conduit 44. From there, the liquid travels through flexible tube 30 and back to supply 36 through outlet conduit 46. In this manner, flexible tubing 30 is temperature controlled, and in turn, controls the temperature of flexible panels 32 and 34 of flexible wrapping 12, and therefore, the horse's leg. Further, with the present invention, for therapeutic treatments, there is the capacity to treat two legs simultaneously while the legs and feet remain dry. Although not shown, conduits 44 and 46 are connected to wrapping 12 and supply 36 by comprehension fittings which will detach easily and are fitted with checkballs or one-way valves 52 to immediately stop the flow of water in either direction.

Figure 6:
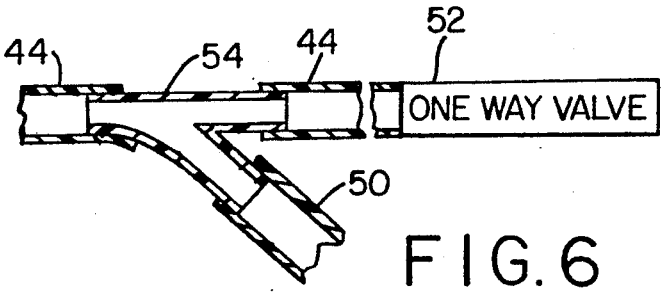
FIG. 6 is an enlarged cross-sectional view, showing the attachment of the air conduit to the water conduit.

In accordance with the present invention, an air pump 48, which is also powered by power supply 42, supplies air to inlet conduit 44 through an air line 50. As shown in FIG. 6, one manner of attaching conduit 50 to conduit 40 is by a Y-connector 54. Although not shown in FIG. 1, it will be appreciated that air pump 48 is preferably a small portable air pump which can be attached to the side of supply 36. As a result, air, and particularly, air bubbles, are pumped into inlet conduit 44, and flow with the liquid through flexible tube 30. Preferably, the air is supplied during a non-cooling procedure, for example, when water at room temperature or higher is used, although air can be also supplied during a cooling procedure. As a result, there is a turbulent reaction in the normal flow pattern of the liquid which imparts a whirlpool/hydrotherapy effect that causes stimulation of blood flow. Thus, once water flow begins, air is pumped into the lines causing the aforementioned spa-like feeling. The warm water may be used to further stimulate the blood flow.

It will therefore be appreciated that, with the present invention, the combination of water and air in a leg wrapping will stimulate blood flow to the horse's leg.

Figure 7:
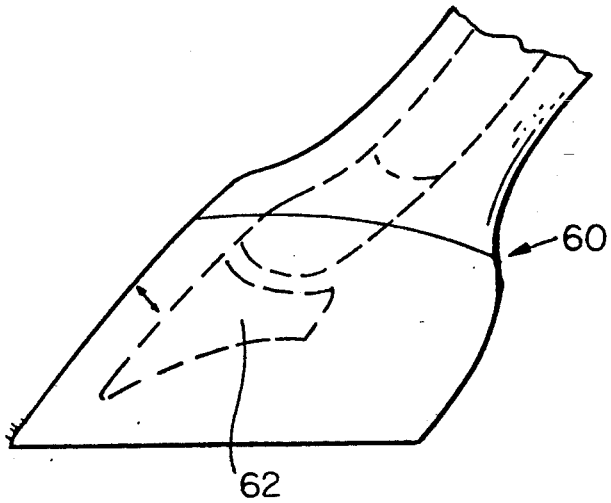
FIG. 7 is a schematic elevational view of a normal foot of a horse.
Figure 8:
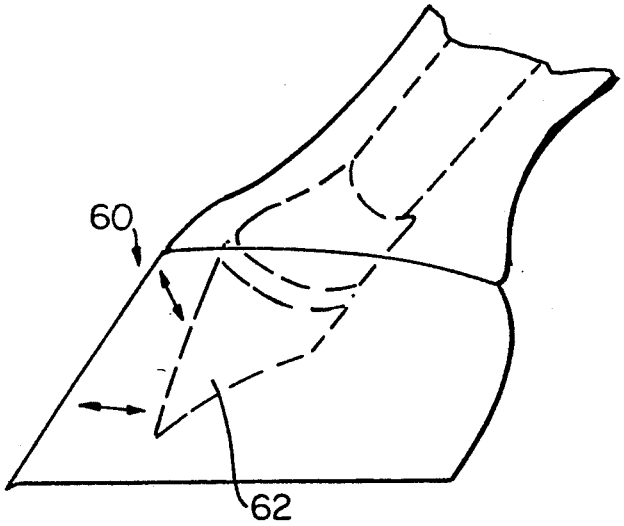
FIG. 8 is a schematic elevational view of an abnormal foot of a horse having laminitis.

Prior to discussing further embodiments of the present invention, it is noted, as shown in FIGS. 7 and 8, that the part of the foot 60 of a horse which holds the bone to the hoof wall is termed the laminae. This area often becomes inflamed and congested with blood, causing severe pain to the horse. If the problem is not addressed, the coffin bone 62 will detach itself from the hoof wall and rotate downwardly, as shown in FIG. 8.

Some studies have shown that by either providing controllable support, and heating or cooling the foot, this condition can be relieved.

The present invention also addresses this problem by providing regulated support for the sole of the hoof during acute stages of laminitis. This is accomplished by providing cooling/heating of the foot in combination with controlled pressure from an air bladder 70 positioned under the hoof, where the pressure of the air bladder 70 can be controlled by a pressure bulb 72 through a conduit 77. In this regard, it is noted that the pressure of air bladder 70 must be changeable to compensate for additional rotation of coffin bone 62.

Figure 9:
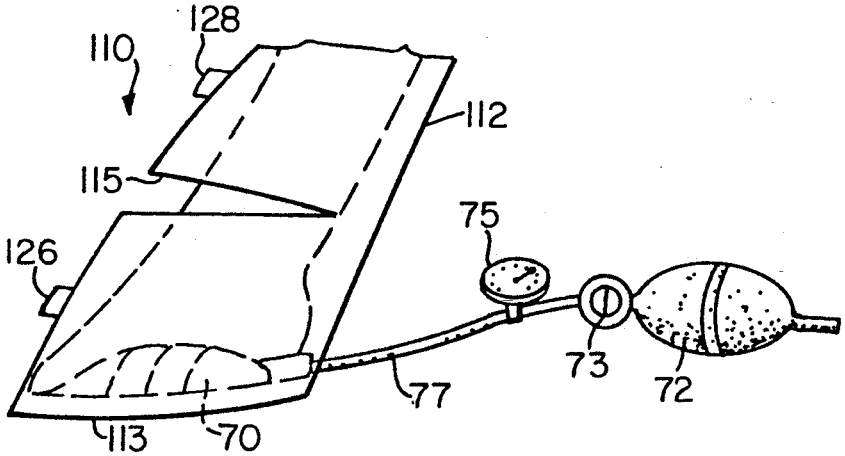
FIG. 9 is a schematic, elevational view of apparatus for massaging the legs of a horse, while also providing regulated support for the sole of the hoof of each foot in order to aid in healing of the foot during laminitis, according to another embodiment of the invention.

Thus, as shown in FIG. 9, apparatus 110 according to another embodiment of the present invention incorporates air bladder 70 and pressure bulb 72 within a boot 112. Specifically, boot 112 is constructed in a manner similar to flexible wrapping 12 of apparatus 10, but instead, is formed as a continuous wrapping with a closed bottom 113. In addition, approximately midway along the height of boot 112, a transverse cut 115 is provided which is opened at the forward end of the boot 112 and extends toward the rear portion of the boot 112 in order to permit flexing of the horse's leg and foot without undue discomfort. As with flexible wrapping 12, boot 112 is formed so as to sandwich a sinusoidal or helical flexible tube (not shown) therein having an inlet opening 126 and an outlet opening 128 which are connected by conduits to a supply of liquid and/or in the same manner as apparatus 10. With this arrangement, in addition to the hydrotherapy effect from boot 112, air bladder 70 is mounted on the upper surface of bottom layer 113 of boot 112 and the air pressure therein can be regulated by pressure bulb 72, with the pressure locked therein by a valve 73. In addition, a pressure gauge 75 can be associated therewith to determine the amount of pressure in air bladder 70.

With this arrangement, an air/liquid combination can be supplied to inlet opening 126 and circulated within boot 112 and, at the same time, air bladder 70 can be inflated to compensate for rotation of coffin bone 62.

Figure 10:
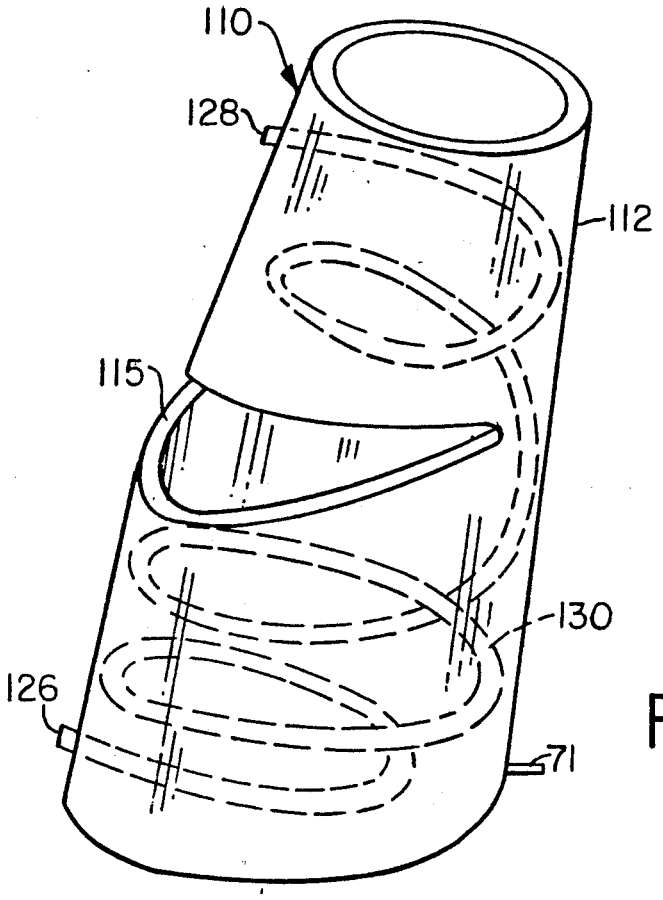
FIG. 10 is a perspective view of the apparatus of FIG. 9.

FIG. 10, for ease of explanation, eliminates air bladder 70, although it will be appreciated that air bladder is present therein. FIG. 10 does, however, show a helical arrangement of flexible tubing 130.

Figure 12:
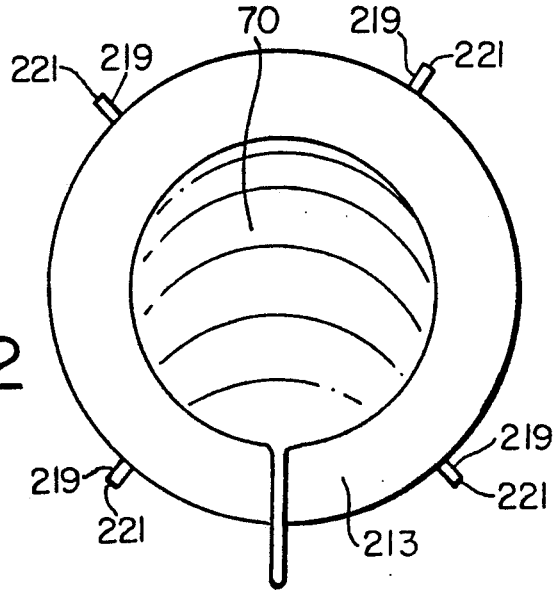
FIG. 12 is a top plan view of a foot support and air bladder for providing regulated support for the sole of the hoof of each foot, which can be connected with the flexible wrap of FIG. 11 to form a boot.
Figure 11:
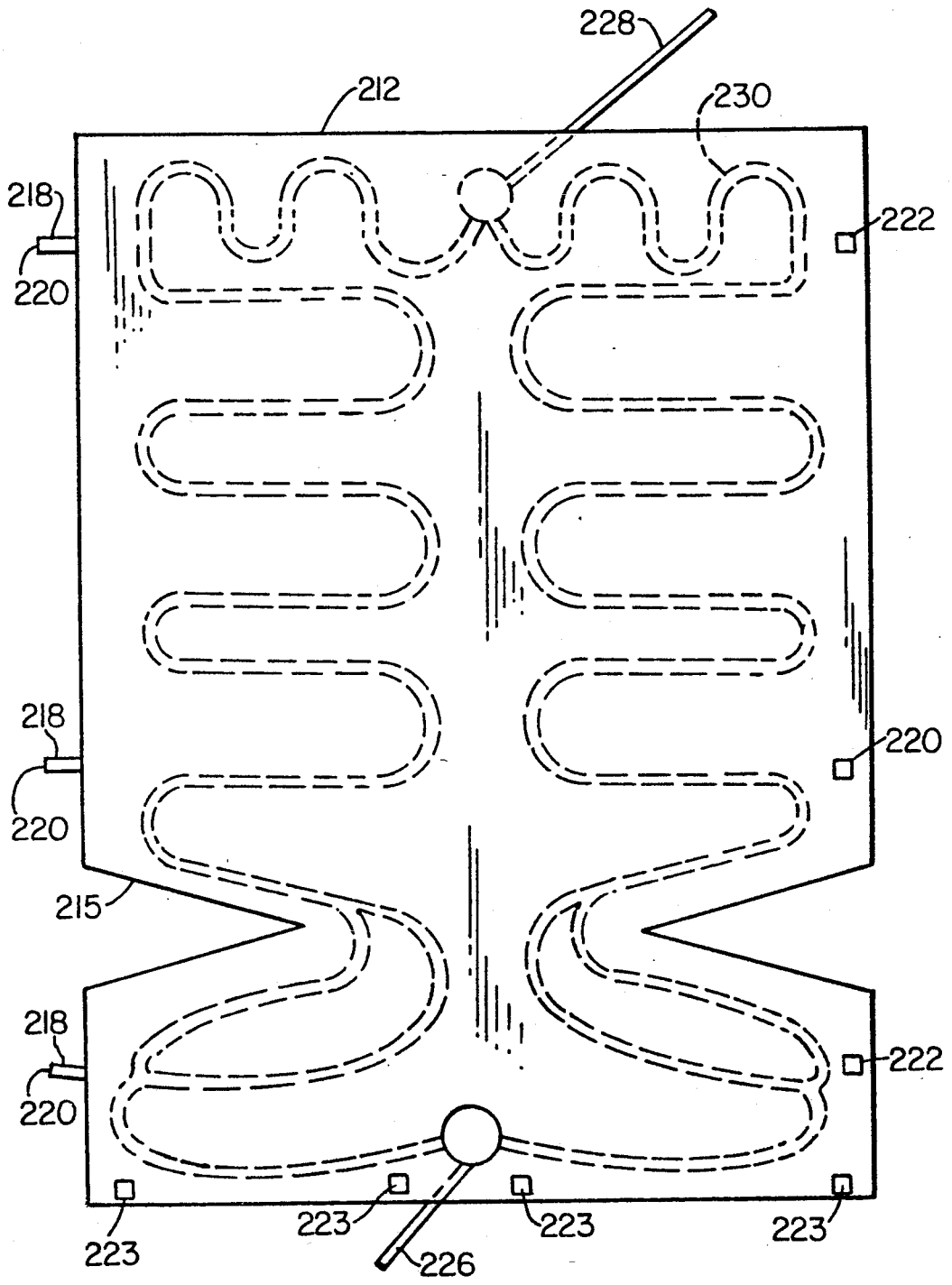
FIG. 11 is a plan view of a wrap of apparatus for massaging the legs of a horse, according to still another embodiment of the present invention.

Referring now to FIGS. 11 and 12, apparatus 210 according to a preferred embodiment of the present invention will now be described in which elements corresponding to those discussed above with respect to apparatus 110 are identified by the same reference numerals, augmented by 100.

Rather than forming the boot as an integral assembly as in the embodiment of FIGS. 9 and 10, apparatus 210 forms the boot in two sections, namely a flexible wrapping section 212 (FIG. 11) and a bottom section 213 (FIG. 12). Flexible wrapping section 212 includes flexible tubing 230 therein, which has an inlet opening 226 and an outlet opening 228 which is connected with a supply of liquid. It will be appreciated that flexible tubing 230 is arranged in a different pattern than flexible tube 130 of FIG. 10. Straps 218 having "VELCRO"-type loops 220 at the ends thereof are connectable with "VELCRO"-type hooks 222 mounted at the opposite side of flexible wrapping 212 so as to removably secure flexible wrapping 212 about the leg and foot of a horse.

In addition, the lower edge of flexible wrapping 212 is provided with "VELCRO"-type hooks 223 mounted thereat for connection with "VELCRO"-type loops 221 mounted at the free ends of straps 219 extending from base section 213. In this manner, when flexible wrapping 212 is wrapped about the leg of a horse and secured therearound, the horse's foot can then be placed on air bladder 70, which is mounted to bottom section 213, and bottom section 213 can be removably secured to flexible wrapping 212.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. Apparatus for massaging the legs of a horse, comprising:

flexible wrapping means for encasing a portion of at least one leg of a horse, said flexible wrapping means including passage means for permitting circulation of a fluid through said flexible wrapping means, said passage means including an inlet and an outlet, and said fluid comprising a mixture of a liquid and air;

inlet conduit means for supplying said liquid from a supply of liquid to said inlet of said passage means;

outlet conduit means for conveying the liquid from said outlet of said passage means back to said liquid supply; and pump means for pumping the liquid from said liquid supply to said inlet conduit means to control the temperature of said at least one leg of said horse and for simultaneously pumping air to said inlet conduit means in mixing relation with said liquid to form said fluid before entry to said passageway;

wherein said air is delivered and mixed with said liquid to such an extent that said fluid provides a massaging action to said at least one leg of said horse.

2. Apparatus according to claim 1, wherein said passage means includes at least one flexible tube extending through the flexible wrapping means.

3. Apparatus according to claim 2, wherein said at least one flexible tube extends through the flexible wrapping means in a tortuous manner.

4. Apparatus according to claim 1, wherein the liquid is water.

5. Apparatus according to claim 1, wherein said pump means includes liquid pump means for pumping said liquid from the supply to said inlet conduit means and air pump means for simultaneously pumping air to said inlet conduit means in mixing relation with said liquid.

6. Apparatus according to claim 5, further including air conduit means for receiving said air from said air pump means and connection means for connecting said air conduit means to said inlet conduit means.

7. Apparatus for massaging and controllably supporting the legs of a horse, comprising:

boot means for encasing at least one foot of a horse, said boot means including passage means for permitting circulation of a fluid through said boot means, said passage means including an inlet and an outlet, and said fluid comprising a mixture of a liquid and air;

inlet conduit means for supplying the liquid from a supply of liquid to said inlet of said passage means;

outlet conduit means for conveying the liquid from said outlet of said passage means back to the supply;

pump means for pumping said liquid from said liquid supply to said inlet conduit means and for simultaneously pumping said air to said inlet conduit means in mixing relation with said liquid to form said fluid before entry to said passageway;

wherein said air is delivered and mixed with said liquid to such an extent that said fluid provides a massaging action to said at least one foot of said horse;

air bladder means for providing regulated support for the sole of the hoof of each said foot in order to aid in healing of the foot during laminitis, said air bladder means being positioned within said boot means and beneath the sole of the hoof of each said foot; and inflation means for inflating said air bladder means to a desired pressure.

8. Apparatus according to claim 7, wherein said passage means includes at least one flexible tube extending through the boot means.

9. Apparatus according to claim 8, wherein said at least one flexible tube extends through the boot means in a tortuous manner.

10. Apparatus according to claim 7, wherein the liquid is water.

11. Apparatus according to claim 7, wherein said pump means includes liquid pump means for pumping said liquid from said supply to the inlet conduit means and air pump means for simultaneously pumping air to said inlet conduit means in mixing relation with said liquid.

12. Apparatus according to claim 11, further including air conduit means for receiving said air from said air pump means and connection means for connecting said air conduit means to said inlet conduit means.

13. Apparatus according to claim 7, wherein said inflation means includes a pressure bulb fluidly connected with said air bladder means.

14. Apparatus according to claim 7, wherein said boot means is formed as an integral structure with a continuous side wall and a bottom wall connected thereto, and said air bladder means is mounted on said bottom wall.

15. Apparatus according to claim 7, wherein said boot means is formed from a flexible wrapping means containing said passage means and which forms a side wall of said boot means, and a bottom section which has said air bladder means mounted thereon, and further including removable securement means disposed on said flexible wrapping means and said bottom section for removably securing said bottom section to said flexible wrapping means.

* * * * *